US010966468B2

(12) United States Patent
Waitz et al.

(10) Patent No.: US 10,966,468 B2
(45) Date of Patent: Apr. 6, 2021

(54) GARMENT WITH INNER PANEL

(71) Applicant: HBI Branded Apparel Enterprises, LLC, Winston-Salem, NC (US)

(72) Inventors: Sandra Ann Waitz, New York, NY (US); Catherine Shannon, Brooklyn, NY (US)

(73) Assignee: HBI Branded Apparel Enterprises, LLC, Winston Salem, NC (US)

( * ) Notice: Subject to any disclaimer, the term of this patent is extended or adjusted under 35 U.S.C. 154(b) by 436 days.

(21) Appl. No.: 15/681,951

(22) Filed: Aug. 21, 2017

(65) Prior Publication Data

US 2018/0055095 A1 Mar. 1, 2018

Related U.S. Application Data

(60) Provisional application No. 62/381,986, filed on Aug. 31, 2016.

(51) Int. Cl.

| | |
|---|---|
| ***A41B 9/00*** | (2006.01) |
| ***A41B 9/04*** | (2006.01) |
| ***A41D 27/02*** | (2006.01) |

(52) U.S. Cl.

CPC ..... *A41B 9/004* (2013.01); *A41B 9/04* (2013.01); *A41D 27/02* (2013.01); *A41B 2300/30* (2013.01); *A41B 2300/35* (2013.01)

(58) Field of Classification Search

CPC ..... A41B 9/005; A41B 9/007; A41B 9/004

(Continued)

(56) References Cited

U.S. PATENT DOCUMENTS

| | | | |
|---|---|---|---|
| 1,487,670 | A | 3/1924 | Slikerman |
| 2,506,488 | A | 5/1950 | Cass |

(Continued)

FOREIGN PATENT DOCUMENTS

| | | | |
|---|---|---|---|
| CN | 1206974 | A | 2/1999 |
| CN | 100456975 | C | 2/2009 |

(Continued)

OTHER PUBLICATIONS

International Search Report and Written Opinion in International Application No. PCT/US2017/048223, dated Oct. 30, 2017, 17 pages.

(Continued)

*Primary Examiner* — Katherine M Moran

(74) *Attorney, Agent, or Firm* — Fish & Richardson P.C.

(57) ABSTRACT

A female undergarment including a first fabric layer having an abdominal region and a crotch region and a second fabric layer secured to the first fabric layer at the crotch region and at the abdominal region. The crotch region is defined by first and second leg openings. The second fabric layer, secured to the first fabric layer at the crotch region and at the abdominal region, defines a first opening between the first fabric layer and the second fabric layer proximate the first leg opening and a second opening between the first fabric layer and the second fabric layer proximate the second leg opening. Manufacturing the undergarment includes forming a first fabric layer having an abdominal region and a crotch region, and securing a second fabric layer to the first fabric layer at the crotch region and at the abdominal region, thereby defining the first opening and the second opening.

20 Claims, 5 Drawing Sheets

(58) Field of Classification Search
USPC ..... 2/408, 400, 401, 402
See application file for complete search history.

(56) References Cited

U.S. PATENT DOCUMENTS

| | | | | |
|---|---|---|---|---|
| 2,732,556 | A | 1/1956 | Erteszek | |
| 3,023,419 | A | 3/1962 | Strahle | |
| 3,142,301 | A | 7/1964 | Erteszek | |
| 3,533,412 | A | 10/1970 | Bayer | |
| 3,712,308 | A * | 1/1973 | Herbener | A41B 9/005 450/95 |
| 4,476,895 | A | 10/1984 | Shibusawa | |
| 4,538,615 | A * | 9/1985 | Pundyk | A41C 1/003 450/131 |
| 4,637,078 | A * | 1/1987 | Southwell | A41B 9/007 2/408 |
| 4,747,846 | A * | 5/1988 | Boland | A61F 5/4401 604/385.22 |
| 5,060,315 | A * | 10/1991 | Ewing | A41B 9/005 2/109 |
| 6,610,901 | B2 * | 8/2003 | McMahon-Ayerst | A41B 9/12 604/378 |
| 6,807,685 | B1 | 10/2004 | Hasegawa | |
| 7,814,569 | B2 * | 10/2010 | Di Lorenzo | A41D 7/00 2/67 |
| 7,823,223 | B2 | 11/2010 | Ehmsen | |
| 9,301,550 | B2 | 4/2016 | Sabin | |
| 2002/0007171 | A1 | 1/2002 | McMahon-Ayerst et al. | |
| 2006/0277663 | A1 * | 12/2006 | King | A41B 9/007 2/406 |
| 2008/0229487 | A1 | 9/2008 | Gu-Beom | |
| 2008/0256676 | A1 | 10/2008 | Di Lorenzo | |
| 2013/0111652 | A1 | 5/2013 | Ignatius | |
| 2014/0273735 | A1 | 9/2014 | Larren et al. | |
| 2014/0359920 | A1 * | 12/2014 | Sabin | A41B 9/004 2/406 |
| 2016/0183601 | A1 | 6/2016 | Sabin | |
| 2017/0156411 | A1 * | 6/2017 | Suarez | A41C 1/10 |
| 2019/0045856 | A1 * | 2/2019 | Musciacchio | A41D 7/00 |

FOREIGN PATENT DOCUMENTS

| | | | |
|---|---|---|---|
| WO | WO2004075801 | | 9/2004 |
| WO | WO2013058801 | A1 | 4/2013 |
| WO | WO2014164411 | A1 | 10/2014 |
| WO | WO2014197332 | A2 | 12/2014 |

OTHER PUBLICATIONS

Chinese Office Action in Chinese Application 201780059531, dated Apr. 20, 2020, 17 pages with English Translation.

* cited by examiner

GARMENT WITH INNER PANEL

CROSS-REFERENCE TO RELATED APPLICATION

This application claims the benefit of U.S. Patent Application Ser. No. 62/381,986 entitled "GARMENT WITH INNER PANEL" and filed on Aug. 31, 2016, which is incorporated by reference herein in its entirety.

TECHNICAL FIELD

The present invention relates to a garment having an inner panel extending from the abdominal region to the crotch region of the garment, the inner panel designed to redistribute tension and pull of the leg opening and center front of the garment at the gusset seam.

BACKGROUND

Undergarments, particularly female undergarments such as briefs and body briefers, often create pressure points around the leg and center front of the leg when worn. These pressure points may be attributed to design and construction, as well as the fabrics and components, such as closure panels, of which they are made.

SUMMARY

In a first general aspect, a female undergarment includes a first fabric layer having an abdominal region and a crotch region, and a second fabric layer secured to the first fabric layer at the crotch region and at the abdominal region. The crotch region is defined by a first leg opening and a second leg opening. The second fabric layer, secured to the first fabric layer at the crotch region and at the abdominal region, defines a first opening between the first fabric layer and the second fabric layer proximate the first leg opening and a second opening between the first fabric layer and the second fabric layer proximate the second leg opening.

In a second general aspect, manufacturing a female undergarment includes forming a first fabric layer having an abdominal region and a crotch region, and securing a second fabric layer to the first fabric layer at the crotch region and at the abdominal region. The crotch region is defined by a first leg opening and a second leg opening. Securing the second fabric layer to the first fabric layer at the crotch region and the abdominal region defines a first opening between the first fabric layer and the second fabric layer proximate the first leg opening and a second opening between the first fabric layer and the second fabric layer proximate the second leg opening.

Implementations of the first and second general aspects may include one or more of the following features.

In some implementations, a width of the second fabric layer at the abdominal region exceeds a width of the second fabric layer at the crotch region. In some examples, the second layer is shaped substantially like a trapezoid or a pentagon. In certain examples, the second layer is shaped substantially like a chevron or truncated chevron. The second layer may include a mesh fabric. The second fabric layer is typically configured to distribute a vertical pull in the crotch region across the abdominal region when worn, thereby relieving tension at the first leg opening and the second leg opening.

In some implementations, the first layer includes a midriff region, a bust region, or both. The first layer may include shoulder straps defining arm openings. The first layer may include a lace portion.

In some implementations, the second fabric layer is sewn to the first fabric layer at the crotch region and at the abdominal region to yield a seam at the crotch region and a seam at the abdominal region. The seam at the crotch region and the seam at the abdominal region may both be continuous seams. A length of the seam at the abdominal region typically exceeds a length of the seam at the crotch region.

In some implementations, the crotch region includes a closure panel, and a first portion of the closure panel overlaps and secures to a second portion of the closure panel to define the first leg opening and the second leg opening. The closure panel may be a hook and eye closure panel, with the first portion of the closure panel including hooks and the second portion of the closure panel including loops. The first portion of the closure panel is typically tapered to narrow toward a free end of the first portion of the closure panel, and the second portion of the closure panel is typically tapered to narrow toward a free end of the second portion of the closure panel. The first portion of the closure panel and the second portion of the closure panel may be edged with foldover elastic, such that the foldover elastic defines a portion of the first leg opening and a portion of the second leg opening. The first portion of the closure panel and the second portion of the closure panel may be edged with a microfiber foldover elastic, such that the microfiber foldover elastic defines a portion of the first leg opening and a portion of the second leg opening.

Implementations of the second general aspect may include one or more of the following features.

Securing the second fabric layer to the first fabric layer at the crotch region and at the abdominal region may include sewing the second fabric layer to the first fabric layer at the crotch region and at the abdominal region to yield a first seam and a second seam, respectively. A length of the second seam may exceed a length of the first seam.

Advantages of the undergarment described herein include the redistribution of tension resulting from vertical pull in the narrower crotch region to the wider abdominal region of the first fabric layer when worn. This redistribution of tension provides a more even pull along the legs of a wearer, thereby reducing or eliminating tension at the leg openings, reducing or eliminating common pressure points, and providing more coverage to the wearer as well as a more comfortable and attractive fit.

DETAILED DESCRIPTION

Figure 1:
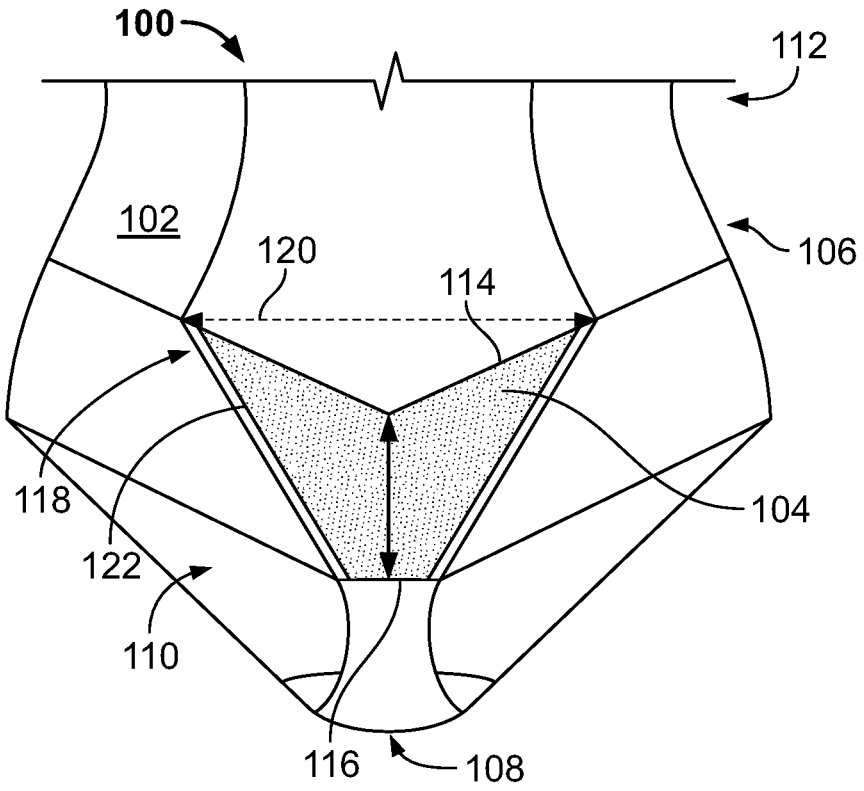
FIG. 1 depicts a portion of a first exemplary garment having an inner panel extending from an abdominal region to a crotch region of a wearer.

FIG. 1 depicts a portion of a front outer side of exemplary garment 100 having first fabric layer 102 and second fabric layer 104. Garment 100 is typically a female undergarment, such as a brief.

First fabric layer 102 may include one or more pieces of one or more types of fabric sewn or otherwise secured together to form a shell having an abdominal region 106 and a crotch region (or gusset area) 108. In some cases, a portion of first fabric layer 102 includes lace. Crotch region 108 is defined by leg openings 110. In certain cases, first fabric layer 102 includes a midriff region 112.

Second fabric layer 104, not visible from an outer side of garment 100, is shaded to indicate its location with respect to first fabric layer 102. Second fabric layer 104 may be formed out of a fabric that is the same as or different than a fabric present in first fabric layer 102. In one example, second fabric layer 104 is formed out of a mesh fabric. Second fabric layer 104 is secured to first fabric layer 102 at abdominal region 106 and crotch region 108. In some cases, second fabric layer 104 is secured to first fabric layer with seams 114 and 116 at abdominal region 106 and crotch region 108, respectively. Seams 114 and 116 may be curved or angular continuous seams, such that second fabric layer 104 is secured to first fabric layer 102 along an entire length of the seams. Seams 114 and 116 define openings 118 between first fabric layer 102 and second fabric layer 106. Openings 118 typically extend from abdominal region 106 to crotch region 108 (e.g., from seam 114 to seam 116), thereby allowing second fabric layer 104 to "float" with respect to first fabric layer 102. Edges 122 of second fabric layer 104 at openings 118 may be finished to promote comfort and stretchability. In one example, edges 122 are finished with a foldover microfiber elastic.

Second fabric layer 104 is typically sized and secured to first fabric layer 102 such that a length of first fabric layer 102 and a length of second fabric layer 104 between seams 114 and 116 are substantially the same. That is, the region of garment 100 between seams 114 and 116 typically lies flat on a surface, with no substantial excess of one fabric layer relative to the other. A width of second fabric layer 104 (i.e., a length along line 120) at abdominal region 106 typically exceeds a width of the second fabric layer at crotch region 108. Accordingly, a length of seam 114 typically exceeds a length of seam 116. In some cases, second fabric layer 104 is shaped substantially like a truncated chevron, as depicted in FIG. 1. In certain cases (e.g., when second fabric layer 104 extends to line 120), second fabric layer 104 is shaped substantially like a trapezoid (e.g., an isosceles trapezoid).

Features of second fabric layer 104, such as its shape and the presence of openings 118, redistribute tension resulting from vertical pull in the narrower crotch region to the wider abdominal region of the first fabric layer when worn. This redistribution of tension provides a more even pull along the legs of a wearer, thereby reducing or eliminating tension at the leg openings, reducing or eliminating common pressure points, and providing more coverage to the wearer as well as a more comfortable and attractive fit. The vertical arrow in FIG. 1 depict distribution of a vertical pull in the crotch region across a wider abdominal region.

Figure 2A:
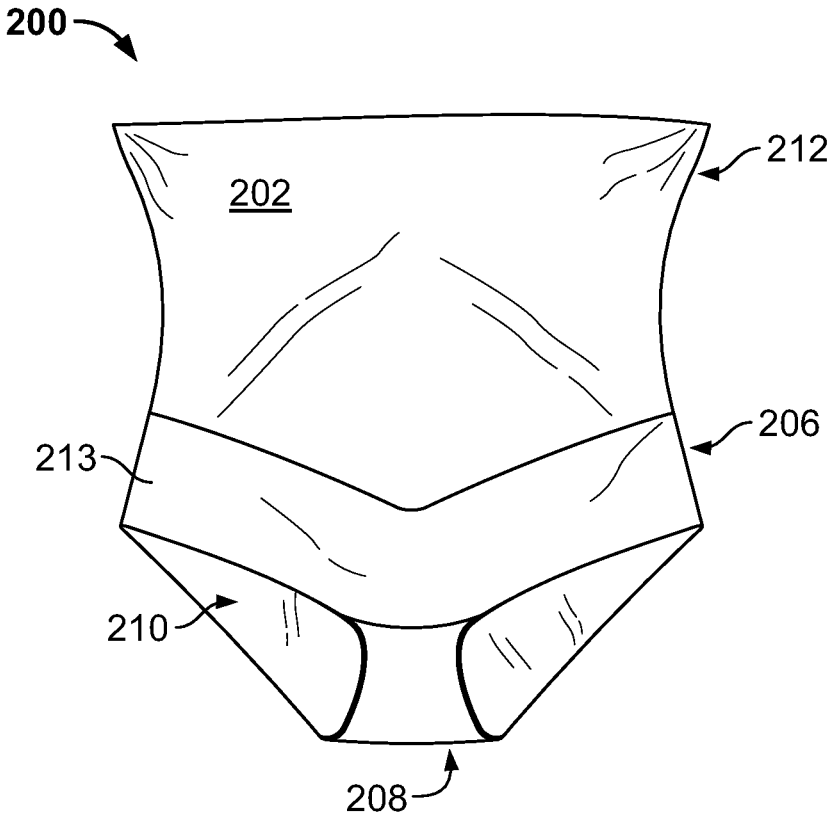
FIGS. 2A-2D are views of an example of the garment of FIG. 1.
Figure 2B:
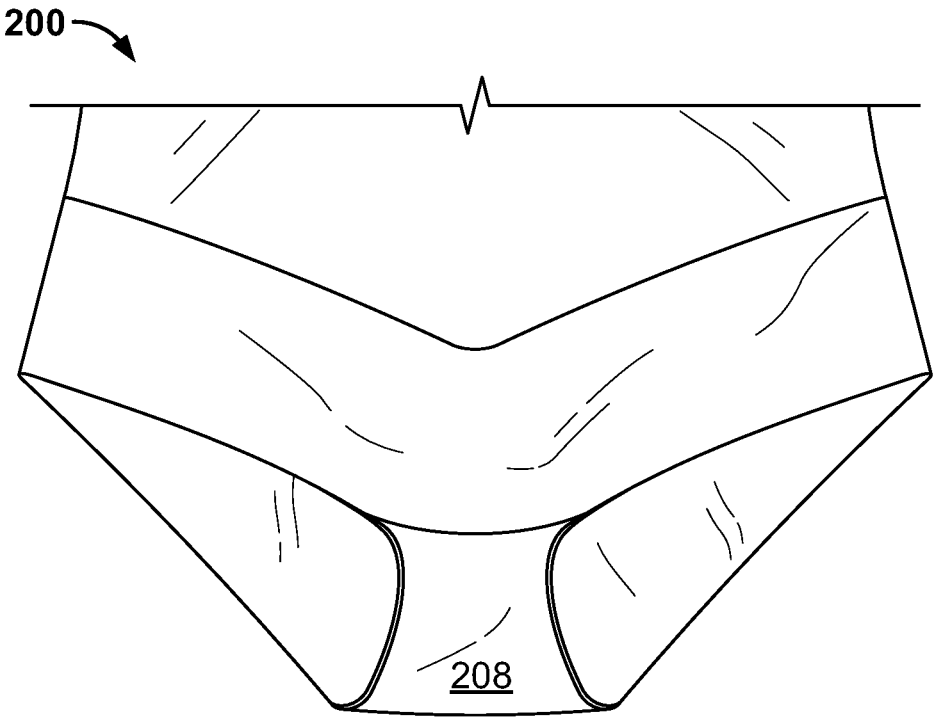
Figure 2C:
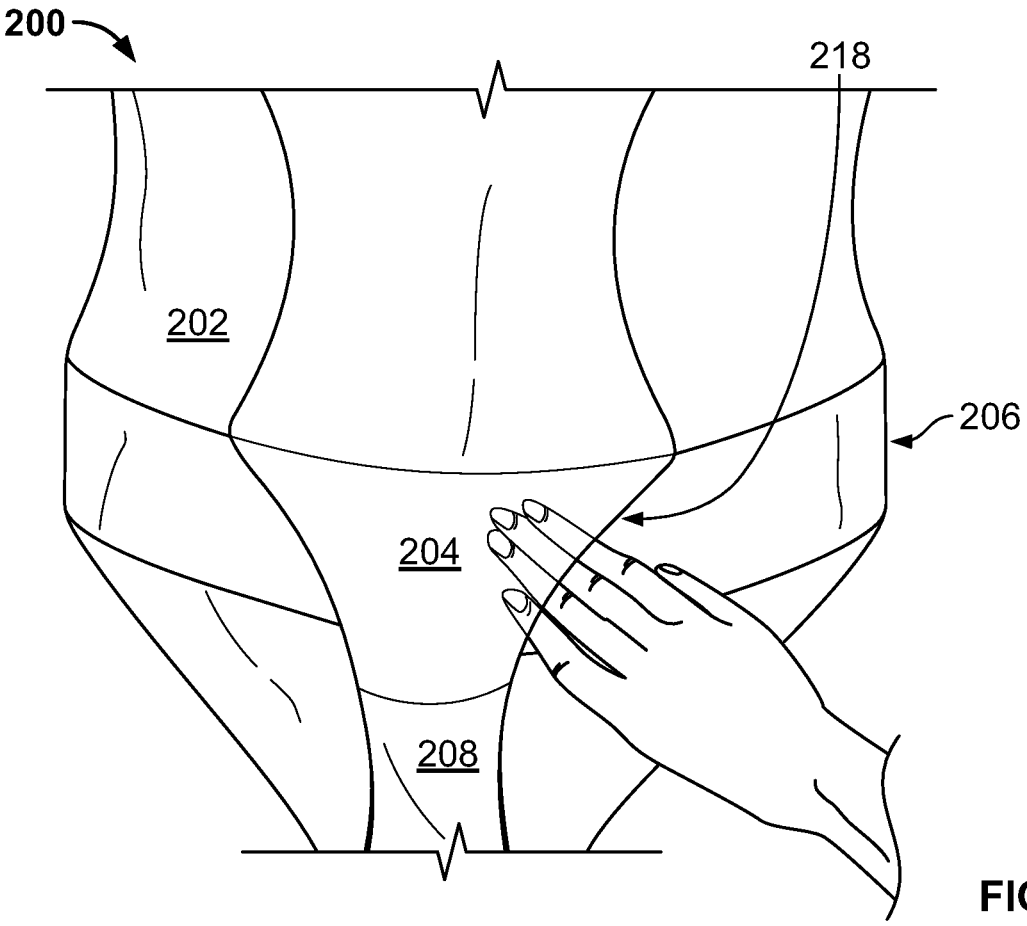
Figure 2D:
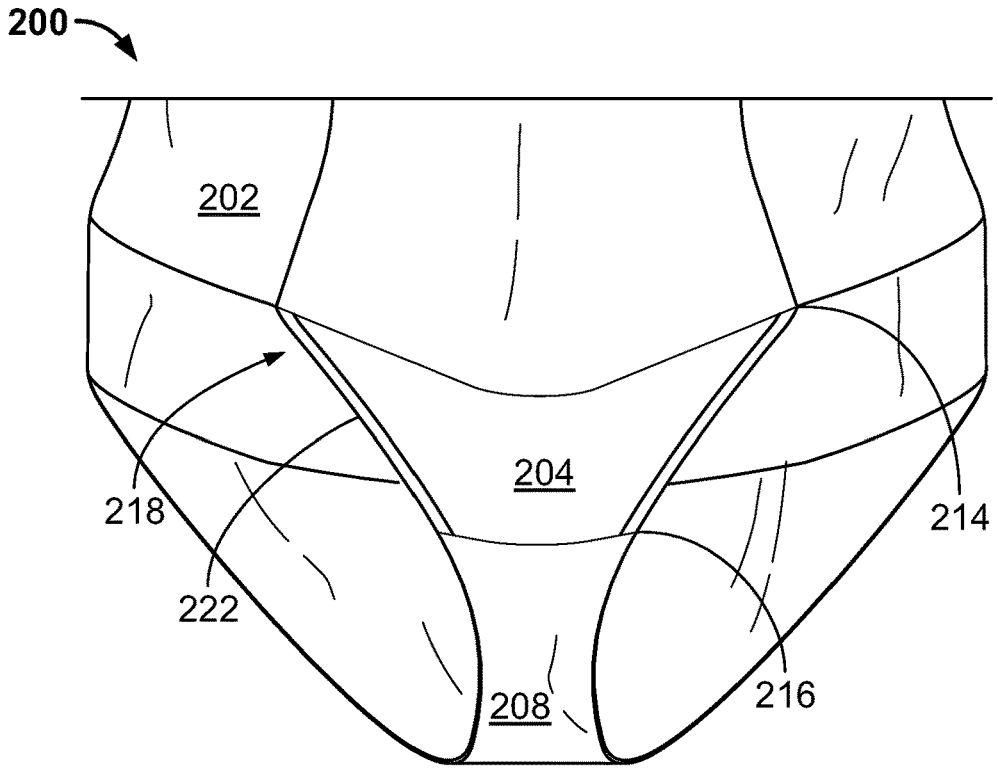

FIGS. 2A-2D show views of an example of the garment described with respect to FIG. 1. In particular, garment 200 is a brief. FIG. 2A shows a front outer side of garment 200, including first fabric layer 202 having abdominal region 206, crotch region 208, and midriff region 212. First fabric layer 202 includes lace portion 213. Crotch region 208 defines leg openings 210. FIG. 2B shows an enlarged view of outer crotch region 208 of garment 200. FIG. 2C shows a front inner side of garment 200, with second fabric layer 204 secured to first fabric layer 202 at abdominal region 206 and crotch region 208. Second fabric layer 204 is a mesh fabric. Openings 218 are highlighted by the presence of hand between first fabric layer 202 and second fabric layer 204. FIG. 2D shows an enlarged view of inner crotch region 208 of garment 200. In garment 200, second fabric layer 204 is shaped substantially like a truncated chevron. As shown in FIG. 2D, seams 214 and 216 are continuous, and the length of seam 214 securing the second fabric layer 204 to the first fabric layer 202 at the abdominal region 206 exceeds the length of the seam 216 securing the second fabric layer to the first fabric layer at the crotch region 208. Edges 222 of openings 218 are encased in a foldover elastic.

Figure 3:
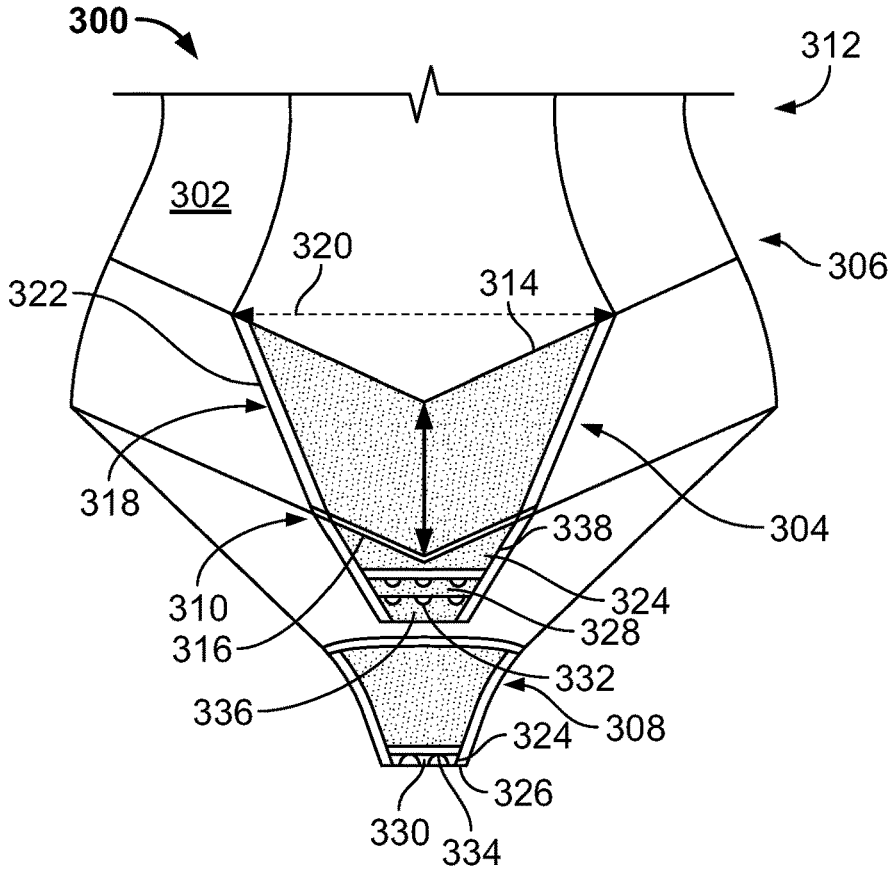
FIG. 3 depicts a portion of a second exemplary garment having an inner panel extending from an abdominal region to a crotch region of a wearer.

FIG. 3 depicts a portion of a front outer side of exemplary garment 300 having first fabric layer 302 and second fabric layer 304. Garment 300 is typically a female undergarment, such as a body briefer.

First fabric layer 302 may include one or more pieces of one or more types of fabric sewn or otherwise secured together to form a shell having an abdominal region 306 and a crotch region (or gusset area) 308. In some cases, a portion of first fabric layer 302 includes lace. Crotch region 308 includes a closure panel as described herein and is defined by leg openings 310. First fabric layer 302 includes a midriff region 312, as well as a bust region and shoulder straps defining arm openings (not shown).

Second fabric layer 304, not visible from an outer side of garment 300, is shaded to indicate its location with respect to first fabric layer 302. Second fabric layer 304 may be formed out of a fabric that is the same as or different than a fabric present in first fabric layer 302. In one example, second fabric layer 304 is formed out of a mesh fabric. Second fabric layer 304 is secured to first fabric layer 302 at abdominal region 306 and crotch region 308. In some cases, second fabric layer 304 is secured to first fabric layer with seams 314 and 316 at abdominal region 306 and crotch region 308, respectively. Seams 314 and 316 may be curved or angular continuous seams, such that second fabric layer 304 is secured to first fabric layer 302 along an entire length of the seams. Seams 314 and 316 define openings 318 between first fabric layer 302 and second fabric layer 304. Openings 318 typically extend from abdominal region 306 to crotch region 308 (e.g., from seam 314 to seam 316), thereby allowing second fabric layer 304 to "float" with respect to first fabric layer 302. Edges 322 of second fabric layer 304 at openings 318 may be finished to promote comfort and stretchability. In one example, edges 322 are finished with a foldover microfiber elastic.

Second fabric layer 304 is typically sized and secured to first fabric layer 302 such that a length of first fabric layer 302 and a length of second fabric layer 304 between seams 314 and 316 are substantially the same. That is, the region of garment 300 between seams 314 and 316 typically lies flat on a surface, with no substantial excess of one fabric layer relative to the other. A width of second fabric layer 304 (i.e., a length along line 320) at abdominal region 306 typically exceeds a width of the second fabric layer at crotch region 308. Accordingly, a length of seam 314 typically exceeds a length of seam 316. In some cases, second fabric layer 304 is shaped substantially like a chevron, as depicted in FIG. 3. In certain cases (e.g., when second fabric layer 304 extends to line 320), second fabric layer 304 is shaped substantially like a pentagon.

Crotch region 308 includes closure panel 324. Closure panel 324, free of stiff interfacing, is soft and flexible, providing comfort when worn. First portion 326 of closure panel 324 overlaps and secures to second portion 328 of the closure panel to define leg openings 310. Closure panel 324 is typically a hook and eye closure panel, with first portion 326 of the closure panel having hooks 330 (e.g., a row of hooks) and second portion 328 of the closure panel having loops 332 (e.g., one or more rows of loops). First portion 326 of closure panel 324 is tapered to narrow toward free end 334, and second portion 328 of the closure panel is tapered to narrow toward free end 336 to reduce chafing when worn. Closure panel 324 has edges 338 finished with a soft, stretchy material (e.g., a foldover elastic, such as a microfiber foldover elastic) that defines a portion of leg openings 310 when worn. Edges 338 ensure that so no sharp edges are exposed during use.

Features of second fabric layer 304, such as its shape and the presence of openings 318, redistribute tension resulting from vertical pull in the narrower crotch region 308 to the wider abdominal region 306 of first fabric layer 302 when worn. This redistribution of tension provides a more even pull along the legs of a wearer, thereby reducing or eliminating tension at the leg opening, reducing or eliminating common pressure points, and providing more coverage to the wearer as well as a more comfortable and attractive fit. The vertical arrow in FIG. 3 depicts distribution of a vertical pull in the crotch region across a wider abdominal region.

Figure 4A:
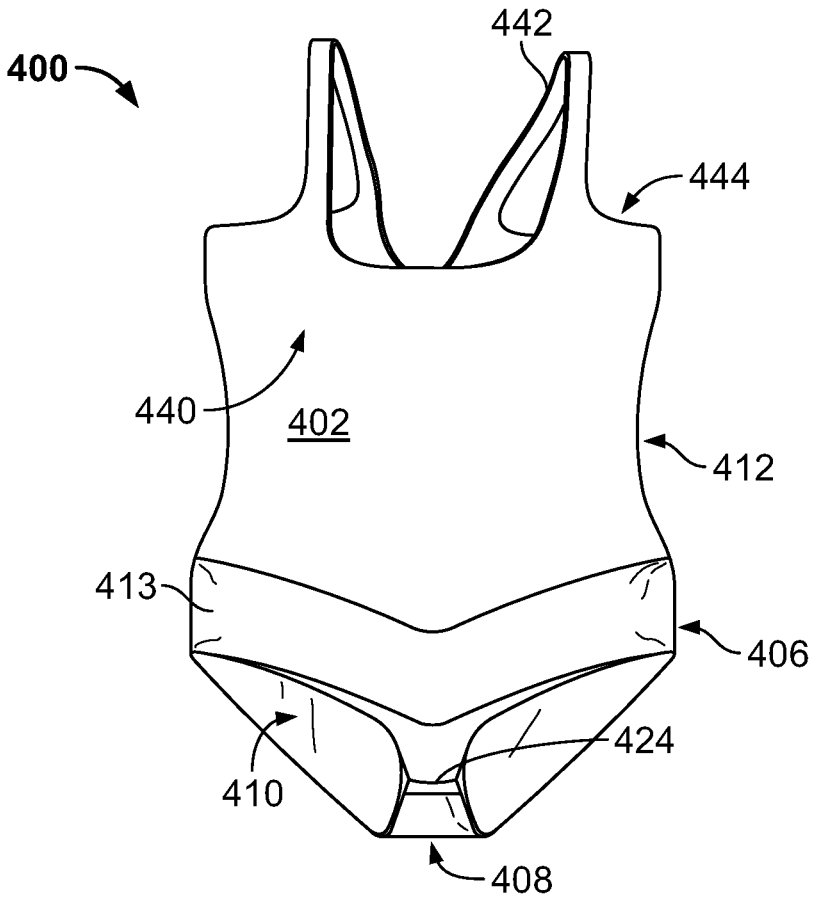
FIGS. 4A-4D are views of an example of the garment of FIG. 3.
Figure 4B:
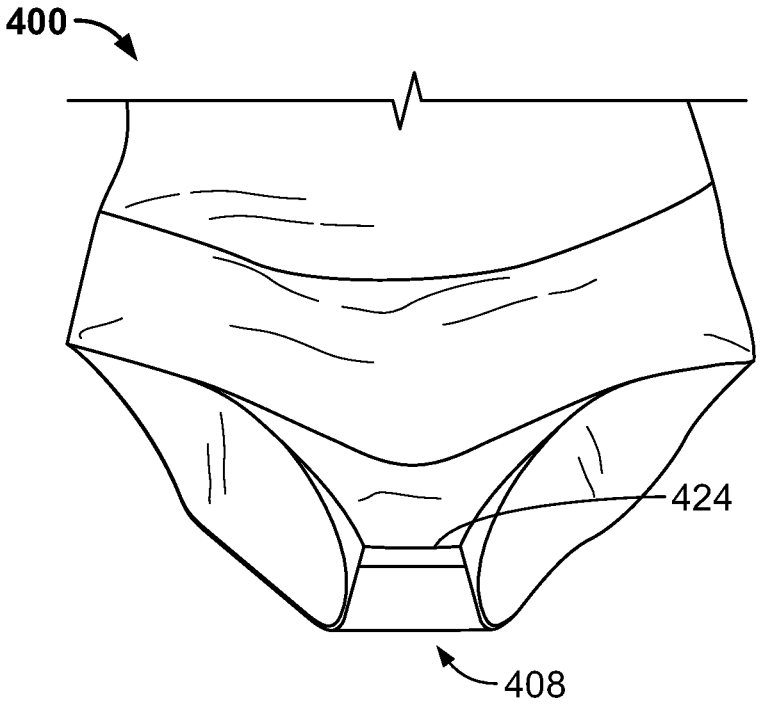
Figure 4C:
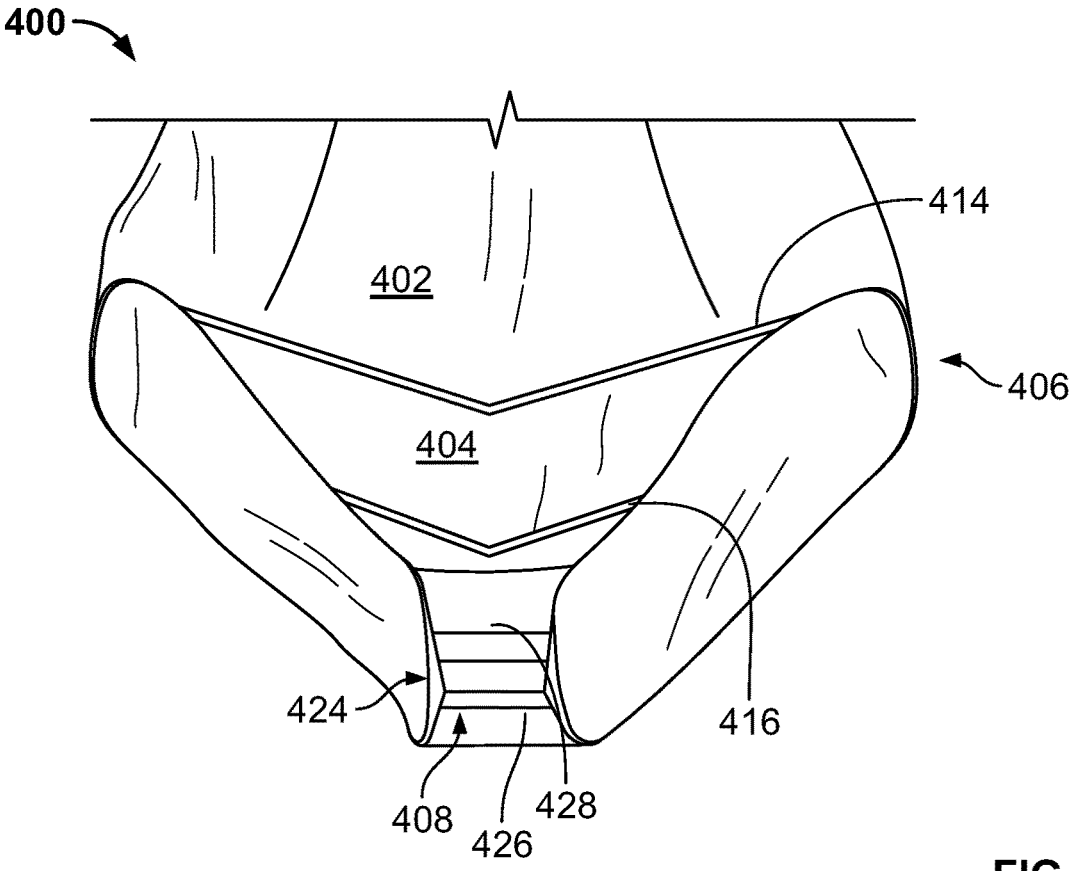
Figure 4D:
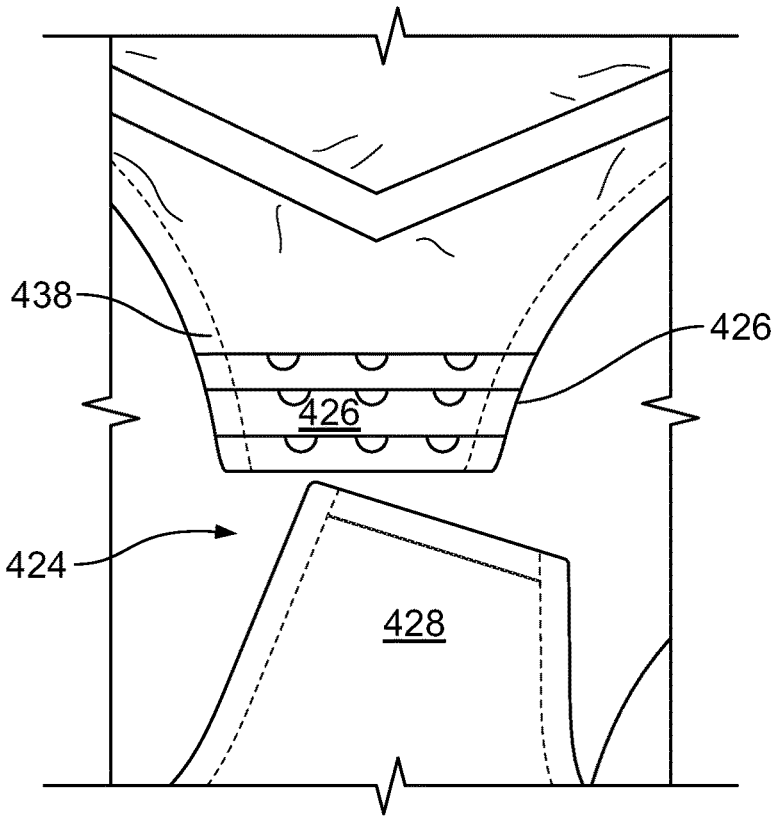

FIGS. 4A-4D show views of an example of the garment described with respect to FIG. 3. In particular, garment 400 is a body briefer. FIG. 4A shows a front outer side of garment 400, including first fabric layer 402 having abdominal region 406, crotch region 408, midriff region 412, bust region 440, and shoulder straps 442 defining arm openings 444. First fabric layer 402 includes lace portion 413. Crotch region 408 with closure panel 424 defines leg openings 410. FIG. 4B shows an enlarged view of outer crotch region 408 of garment 400 with closure panel 424. FIG. 4C shows a front inner side of garment 400, with second fabric layer 404 secured to first fabric layer 402 at seams 414 and 416 in abdominal region 406 and crotch region 408, respectively, as well as first portion 426 and second portion 428 of closure panel 424. In garment 400, second fabric layer 404 is shaped substantially like a chevron. Second fabric layer 404 is a mesh fabric. Seams 414 and 416 are angular and continuous, and the length of seam 414 securing second fabric layer 404 to first fabric layer 402 at abdominal region 406 exceeds the length of seam 416 securing the second fabric layer to the first fabric layer at crotch region 408. FIG. 4D shows an enlarged view of closure panel 424 having tapered first portion 426 and tapered second portion 428. Edges 438 of openings are encased in a foldover elastic.

A method of manufacturing a garment described herein includes forming a first fabric layer comprising an abdominal region and a crotch region, where the crotch region is defined by a first leg opening and a second leg opening. A second fabric layer is secured to the first fabric layer at the crotch region and at the abdominal region, thereby defining a first opening between the first fabric layer and the second fabric layer proximate the first leg opening and a second opening between the first fabric layer and the second fabric layer proximate the second leg opening. Securing the second fabric layer to the first fabric layer at the crotch region and at the abdominal region may include sewing the second fabric layer to the first fabric layer at the crotch region and at the abdominal region to yield a first seam and a second seam, respectively. The length of the second seam typically exceeds a length of the first seam.

Further modifications and alternative embodiments of various aspects will be apparent to those skilled in the art in view of this description. Accordingly, this description is to be construed as illustrative only. It is to be understood that the forms shown and described herein are to be taken as examples of embodiments. Elements and materials may be substituted for those illustrated and described herein, parts and processes may be reversed, and certain features may be utilized independently, all as would be apparent to one skilled in the art after having the benefit of this description. Changes may be made in the elements described herein without departing from the spirit and scope as described in the following claims.

What is claimed is:

1. A female undergarment comprising:

a first fabric layer comprising an abdominal region and a crotch region, wherein the crotch region is defined by a first leg opening and a second leg opening; and a second fabric layer secured to the first fabric layer at the crotch region and at the abdominal region, thereby defining a first opening between the first fabric layer and the second fabric layer proximate the first leg opening and a second opening between the first fabric layer and the second fabric layer proximate the second leg opening, wherein the second fabric layer is sewn to the first fabric layer at a top of the crotch region and at the abdominal region to yield a first seam at the top of the crotch region and a second seam at the abdominal region, wherein the first opening is defined along a first edge of the second fabric layer, where the first edge is a straight edge, and the second opening is defined along a second edge of the second fabric layer, where the second edge is a straight edge, and wherein a width of the second fabric layer at the abdominal region exceeds a width of the second fabric layer at the crotch region, and wherein the second fabric layer is configured to distribute a vertical pull in the crotch region across the abdominal region when worn, thereby relieving tension at the first leg opening and the second leg opening.

2. The female undergarment of claim 1, wherein the first fabric layer comprises a midriff region.

3. The female undergarment of claim 1, wherein the first fabric layer comprises a bust region.

4. The female undergarment of claim 3, wherein the first fabric layer comprises shoulder straps defining arm openings.

5. The female undergarment of claim 1, wherein the second fabric layer is in the shape of a trapezoid or a pentagon.

6. The female undergarment of claim 5, wherein the second fabric layer is in the shape of an isosceles trapezoid or a chevron.

7. The female undergarment of claim 1, wherein the second fabric layer is in the shape of a chevron or truncated chevron.

8. The female undergarment of claim 1, wherein the first fabric layer comprises a lace portion.

9. The female undergarment of claim 1, wherein the second fabric layer comprises a mesh fabric.

10. The female undergarment of claim 1, wherein the first seam at the crotch region is a continuous seam and the second seam at the abdominal region is a continuous seam.

11. The female undergarment of claim 1, wherein a length of the second seam at the abdominal region exceeds a length of the first seam at the crotch region.

12. The female undergarment of claim 1, wherein the crotch region comprises a closure panel, wherein a first portion of the closure panel overlaps and secures to a second portion of the closure panel to define the first leg opening and the second leg opening.

13. The female undergarment of claim 12, wherein the closure panel is a hook and eye closure panel, and the first portion of the closure panel comprises hooks and the second portion of the closure panel comprises eyes, wherein each eye is in the form of a loop.

14. The female undergarment of claim 12, wherein the first portion of the closure panel is tapered to narrow toward a free end of the first portion of the closure panel, and the second portion of the closure panel is tapered to narrow toward a free end of the second portion of the closure panel.

15. The female undergarment of claim 12, wherein the first portion of the closure panel and the second portion of the closure panel are edged with foldover elastic, such that the foldover elastic defines a portion of the first leg opening and a portion of the second leg opening.

16. The female undergarment of claim 15, wherein the first portion of the closure panel and the second portion of the closure panel are edged with a microfiber foldover elastic, such that the microfiber foldover elastic defines a portion of the first leg opening and a portion of the second leg opening.

17. The female undergarment of claim 1, wherein the first edge and the second edge are linear straight edges.

18. The female undergarment of claim 1, wherein an entire length of the first edge is a straight edge, and an entire length of the second edge is a straight edge.

19. A method of manufacturing a female undergarment, the method comprising:

forming a first fabric layer comprising an abdominal region and a crotch region, wherein the crotch region is defined by a first leg opening and a second leg opening; and securing a second fabric layer to the first fabric layer at a top of the crotch region and at the abdominal region, thereby defining a first opening between the first fabric layer and the second fabric layer proximate the first leg opening and a second opening between the first fabric layer and the second fabric layer proximate the second leg opening, wherein securing the second fabric layer to the first fabric layer comprises sewing the second fabric layer to the first fabric layer at the top of the crotch region and at the abdominal region to yield a first seam and a second seam, respectively, and wherein the first opening is defined along a first edge of the second fabric layer, where the first edge is a straight edge, and the second opening is defined along a second edge of the second fabric layer, where the second edge is a straight edge;

wherein the second fabric layer is configured to distribute a vertical pull in the crotch region across the abdominal region when worn, thereby relieving tension at the first leg opening and the second leg opening.

20. The method of claim 19, wherein a length of the second seam exceeds a length of the first seam.

* * * * *